US011090896B2

(12) United States Patent
Hanauer et al.

(10) Patent No.: US 11,090,896 B2
(45) Date of Patent: Aug. 17, 2021

(54) WEB INSERTION DEVICE FOR A FLAT-BED DIE-CUTTING MACHINE, MANUFACTURING SYSTEM FOR PACKAGES AND METHOD FOR FEEDING A WEB OF PRINTING MATERIAL

(71) Applicant: HEIDELBERGER DRUCKMASCHINEN AG, Heidelberg (DE)

(72) Inventors: Tobias Hanauer, Weiherhammer (DE); Hans Schadl, Hirschau (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/297,077

(22) Filed: Mar. 8, 2019

(65) Prior Publication Data

US 2019/0202162 A1 Jul. 4, 2019

Related U.S. Application Data

(63) Continuation-in-part of application No. 15/095,582, filed on Apr. 11, 2016, now abandoned, which is a (Continued)

(30) Foreign Application Priority Data

Oct. 12, 2012 (DE) ..... 102012019992.9

(51) Int. Cl.
*B31B 50/10* (2017.01)
*B31B 50/14* (2017.01)
(Continued)

(52) U.S. Cl.
CPC ..... *B31B 50/102* (2017.08); *B26D 7/02* (2013.01); *B26F 1/40* (2013.01); *B31B 50/142* (2017.08);
(Continued)

(58) Field of Classification Search
CPC .. B41F 21/00; B26F 1/384; B26F 1/40; B26F 1/002; B31B 2201/141; B31B 2201/94;
(Continued)

(56) References Cited

U.S. PATENT DOCUMENTS 2,546,221 A 3/1951 Funk
4,429,603 A * 2/1984 Chapman, Jr. ..... B31B 70/00 83/303
(Continued)

FOREIGN PATENT DOCUMENTS

DE 102004049720 A1 4/2006
EP 2080600 A1 7/2009

*Primary Examiner* — Ghassem Alie
(74) *Attorney, Agent, or Firm* — Laurence A. Greenberg; Werner H. Stemer; Ralph E. Locher

(57) ABSTRACT

A device for inserting a web of printing material into a flat-bed die-cutting and/or embossing machine includes a compensator for converting a continuous movement of the web of printing material into an iterative movement of the web of printing material. A clamping unit clamps the web of printing material, a cutting unit carries out a cross cut through the web of printing material, and an inserting unit transports the web of printing material into the flat-bed die-cutting and/or embossing machine. The device advantageously allows the web of printing material to be automatically clamped, cut and fed to the flat-bed die-cutting and/or embossing machine. As a result, no further stopping of an upstream printing press is required and the amount of waste is reduced. A manufacturing system for producing packages and a method for feeding a web of printing material are also provided.

7 Claims, 12 Drawing Sheets

Related U.S. Application Data continuation-in-part of application No. 14/050,554, filed on Oct. 10, 2013.

(51) Int. Cl.

| | |
|---|---|
| ***B31B 50/88*** | (2017.01) |
| ***B26D 7/02*** | (2006.01) |
| ***B26F 1/40*** | (2006.01) |
| ***B65H 20/18*** | (2006.01) |
| ***B65H 23/00*** | (2006.01) |
| ***B65H 35/00*** | (2006.01) |
| ***B41F 21/04*** | (2006.01) |
| *B31B 120/30* | (2017.01) |

(52) U.S. Cl.

CPC ..... *B31B 50/88* (2017.08); *B41F 21/04* (2013.01); *B65H 20/18* (2013.01); *B65H 23/00* (2013.01); *B65H 35/008* (2013.01); *B31B 2120/302* (2017.08)

(58) Field of Classification Search

CPC ... B31B 2201/88; B31B 1/00; Y10T 83/9457; Y10T 83/8878; Y10T 83/9423; Y10T 83/6654; Y10T 83/9425; Y10T 83/9476; B65H 19/28; B65H 2301/4148; B65H 45/04; B65H 2301/522; B26D 9/00; B26D 7/18

USPC ..... 83/13, 436.9, 685, 821, 202, 212.1, 225, 83/226, 236, 257, 267, 401, 438, 531, 83/533, 652, 826, 825, 684, 686–691; 101/30, 407.1; 493/353; 242/525, 520

See application file for complete search history.

(56) References Cited

U.S. PATENT DOCUMENTS

| | | | | |
|---|---|---|---|---|
| 4,699,031 | A | 10/1987 | D'Angelo et al. | |
| 4,825,917 | A * | 5/1989 | Gonner ..... | B27M 1/00 144/4.9 |
| 6,286,403 | B1 * | 9/2001 | Rosenthal ..... | B26D 1/205 83/152 |
| 6,418,825 | B1 | 7/2002 | Hartmann | |
| 8,408,110 | B2 | 4/2013 | Krauss et al. | |
| 2006/0076449 | A1 | 4/2006 | Stitz et al. | |
| 2010/0080643 | A1 | 4/2010 | Toshito et al. | |

* cited by examiner

WEB INSERTION DEVICE FOR A FLAT-BED DIE-CUTTING MACHINE, MANUFACTURING SYSTEM FOR PACKAGES AND METHOD FOR FEEDING A WEB OF PRINTING MATERIAL

CROSS-REFERENCE TO RELATED APPLICATION

This application is a Continuation-in-Part of U.S. application Ser. No. 15/095,582, filed Apr. 11, 2016, which was a Continuation-in-Part of U.S. application Ser. No. 14/050,554, filed Oct. 10, 2013. This application also claims the priority, under 35 U.S.C. § 119, of German Patent Application DE 10 2012 019 992.9, filed Oct. 12, 2012; the prior applications are herewith incorporated by reference their its entirety.

BACKGROUND OF THE INVENTION

Field of the Invention

The invention relates to a device for inserting a web of printing material, in particular made of paper or board, into a flat-bed die-cutting and/or embossing machine, including a compensator converting a continuous movement of the web of printing material into an iterative movement. The invention further relates to a manufacturing system for the production of packages, in particular made of paper or board, in particular for the production of folding boxes from a web of printing material, including a web-fed printing press, an inserting device and a flat-bed die-cutting and/or embossing device. The invention additionally relates to a method for feeding a web of printing material in a manufacturing system for producing packages from a web-fed printing press to a flat-bed die-cutting and/or embossing machine using an inserting device while the web-fed printing press is in operation.

Die-cutting refers to cutting with closed geometric cutting shapes, which may be circular, oval, polygonal, or any desired shape. The cutting takes place against a cutting pad or die. In some cases, it may be a shearing process. What is cut is mainly sheet-shaped, sometimes web-shaped packaging material made of plastic, foil material, paper, board, cardboard, or corrugated board. A die-cutting process may additionally create crease lines or blind embossments in the blank. Since the final products are packages that are highly sophisticated in terms of their technical and graphic features (special packages for cosmetics, cigarettes, pharmaceuticals, food, etc.), for optimum results, the materials themselves must meet special requirements, the die-cutting tools must operate within narrow tolerances, and the die-cutting machine needs to function with a high degree of accuracy and reliability. The process that best meets those requirements is flat-bed die-cutting. If the material to be processed is sheet-shaped, printed sheets that are stacked on a pallet are fed to the die-cutting machine. If the material to be processed is web-shaped, the web of material is fed to the die-cutting machine by inserting or feed rollers. In order to be able to process the web of printing material while it is stationary, the web of printing material is iteratively stopped by buffering the following section in a web buffer including a dancer roller.

European Patent Application EP 2 080 600 A1, corresponding to U.S. Pat. No. 8,408,110, discloses a flat-bed die-cutting module for die-cutting a printing substrate. The module includes an upper platen and a lower platen. In order to cut a printing substrate passing between the upper platen and the lower platen, a drive is provided to drive a cutting stroke of the lower platen relative to the upper platen, which is stationary and fixed to the machine frame. That causes the lower platen to be engaged with the upper platen and the printing material to be treated by at least one die-cutting tool. A printing substrate transport device for guiding the printing substrate is fixedly received on the lower platen of the flat-bed die-cutting module. The flat-bed die-cutting module may be used in a flat-bed die-cutting machine for processing a web of printing material and may contribute to stabilizing web travel.

For environmental reasons and for reasons of cost efficiency, it is desirable to create as little waste as possible in the manufacturing of the aforementioned packaging materials in the printing press and in the flat-bed die-cutting machine.

When printing presses and die-cutting machines that are disposed in-line relative to each other are started up, the web of material is initially moved out of the machine by a wind-up device or by hand before the web of material is fed to the flat-bed die-cutting machine. That is done to meet stringent quality requirements, in particular to remove any bulges in the web that may be created by guide rollers, for example, when the press is at a standstill, before the die-cutting process starts in the flat-bed die-cutting machine, and thus to prevent the material from jamming. When that process is completed, prior art machines need to be stopped again by an operator, who then needs to cut the web of material at a location upstream of the wind-up device by a cross cut, and subsequently to feed it to the flat-bed die-cutting machine by hand. The repeated stopping of the printing press to feed the web of material to the flat-bed die-cutting machine creates flawed blanks, which means that the first blanks that leave the flat-bed die-cutting machine cannot be used.

BRIEF SUMMARY OF THE INVENTION

It is accordingly an object of the invention to provide a web insertion device for a flat-bed die-cutting machine, a manufacturing system for packages and a method for feeding a web of printing material, which overcome the hereinafore-mentioned disadvantages of the heretofore-known devices, systems and methods of this general type, which significantly reduce the amount of waste that is created when a flat-bed die-cutting and/or embossing machine and/or a production system including a web-fed printing press and a flat-bed die-cutting and/or embossing machine is started up and which simplify handling thereof during start-up.

With the foregoing and other objects in view there is provided, in accordance with the invention, a device for inserting a web of printing material, in particular of paper or board, into a flat-bed die-cutting and/or embossing machine. The device comprises a compensator that converts a continuous movement of the web of printing material into an iterative movement. In accordance with the invention, the inserting device includes a clamping unit for clamping the web of printing material, a cutting unit for carrying out a cross-cut through the web of printing material, creating a cross cut edge, and an inserting unit for transporting the web of printing material, cross cut edge first, into the flat-bed die-cutting and/or embossing machine. Thus, the device advantageously allows automatic clamping, cutting and feeding of the web of printing material into the flat-bed die-cutting and/or embossing machine, dispensing with further stops of the upstream printing press and reducing waste.

A further advantage results from the fact that the feeding of the web of printing material does not require operator invention. Furthermore, the insertion of the web of printing material into the flat-bed die-cutting and/or embossing machine may be accelerated.

In accordance with another advantageous feature of the device of the invention, for inserting a web of printing material, the inserting unit includes a gripper unit for gripping the web of printing material, at least one guide path and a drive associated with the gripper device. The gripper unit is displaceable on the at least one guide path and is moved by the drive.

In accordance with a further feature of the device of the invention, the clamping unit and the gripper unit may be a single subassembly, resulting in a compact and cost-efficient structure.

In accordance with an added preferred feature of the device of the invention for inserting a web of printing material, the device includes an auxiliary wind-up device disposed downstream of the compensator and used to wind-up the web of printing material.

In accordance with an additional particularly advantageous and thus preferred feature of the device of the invention, the clamping unit, the cutting unit and the inserting unit are disposed between the compensator and the flat-bed die-cutting and/or embossing machine. This allows the cutting unit to make the cross cut when the web of printing material is stationary.

In accordance with yet another advantageous feature of the device of the invention, the cutting unit includes at least one knife and at least one counter-element cooperating with the knife, which extend across the width of the web of printing material.

With the objects of the invention in view, there is also provided a manufacturing system for producing packages, in particular made of paper or board, in particular folding boxes, from a web of printing material. The system includes a web-fed printing press, a downstream inserting device according to the invention, and a flat-bed die-cutting and/or embossing machine disposed even further downstream.

With the objects of the invention in view, there is furthermore provided a method for feeding a web of printing material in a manufacturing system for producing packages, in particular as described above, from a web-fed printing press to a flat-bed die-cutting and/or embossing machine using an inserting device according to the invention as described above while the web-fed printing press is in operation. For this purpose, in a first step, the web of printing material is wound onto an auxiliary wind-up device. In a second step, a compensatory movement of a web-guiding element is generated for a temporary standstill of the web, for example by a compensator including a dancer roller. Then, the web of printing material is clamped by a clamping unit and a cross cut is made through the web of printing material, creating a cross cut edge. In a subsequent step, the web of printing material is automatically inserted, cross cut edge first, into the flat-bed die-cutting and/or embossing machine.

The method of the invention likewise offers the aforementioned advantages of little waste and simple feeding of the web of printing material.

Any desired combination of the invention described above and the advantageous embodiments of the invention described above likewise forms an advantageous embodiment of the invention.

Other features which are considered as characteristic for the invention are set forth in the appended claims.

Although the invention is illustrated and described herein as embodied in a web insertion device for a flat-bed die-cutting machine, a manufacturing system for packages and a method for feeding a web of printing material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE INVENTION

Figure 1:
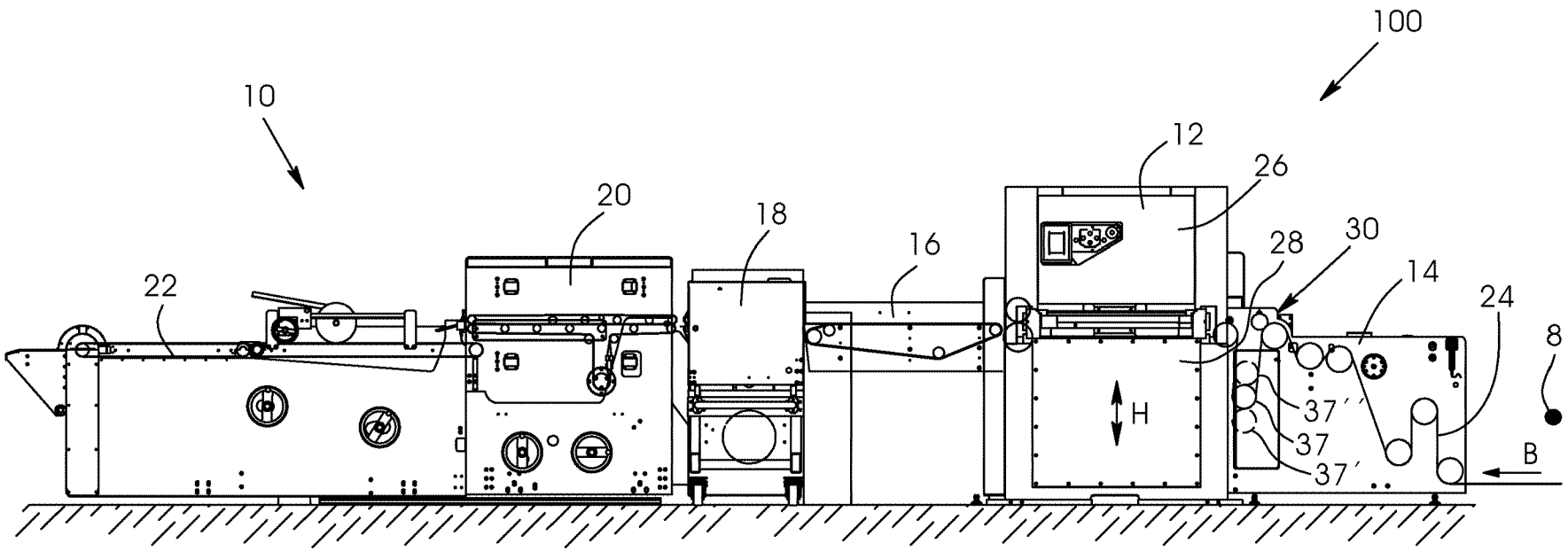
FIG. 1 is a diagrammatic, longitudinal-sectional view of a flat-bed die-cutting machine including an inserting device according to the invention.

Referring now in detail to the figures of the drawings, in which like elements and components bear like reference symbols, and first, particularly, to FIG. 1 thereof, there is seen a diagrammatic representation of a flat-bed die-cutting machine 10 according to the invention, which is part of a manufacturing system 100. In the illustrated embodiment, the flat-bed die-cutting machine 10 includes a flat-bed die-cutting module 12 and has a modular and horizontal construction. In this figure, a web 24 of printing material, for example folding boxes printed on a web 24 of cardboard in an upstream web-fed printing press 8, is processed from the right-hand side to the left-hand side. The web 24 of printing material comes from a web entrance section 14 and enters the flat-bed die-cutting module 12 in a direction B of web travel. In the flat-bed die-cutting module 12, the web 24 of printing material is cut by a stroke H of a lower platen 28 equipped with cutting dies against an upper platen 26 in such a way that in subsequent processing steps, on one hand, individual sheets are severable from the web 24 of printing material and, on the other hand, individual printed products are strippable from the web 24 of printing material and separable from each other. The separation into individual sheets is achieved at the exit of the flat-bed die-cutting module 12. A transporting unit 16 disposed downstream in the flat-bed die-cutting module 12 moves the severed sheets into a stripping unit 18 and a blanking unit 20 in which the printed products are separated from the cut sheets and from each other finally to be delivered in a delivery 22. An inserting device 30 of the invention, which is provided for inserting the web 24 of printing material into the flat-bed die-cutting module 12 and is provided directly upstream of the flat-bed die-cutting module 12, will now be described in more detail with reference to FIG. 2.

Figure 2:
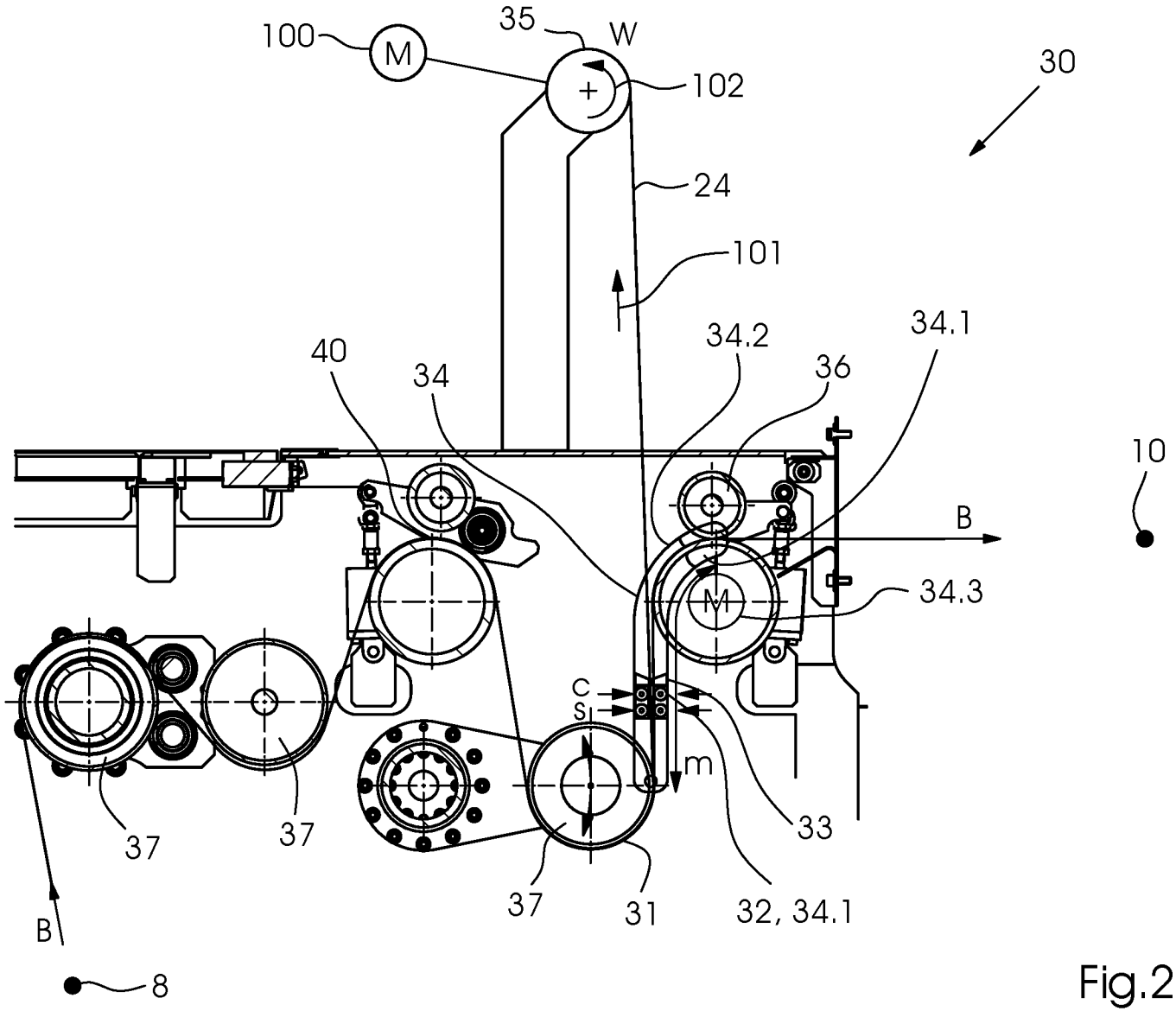
FIG. 2 is an enlarged, fragmentary view of the inserting device.

FIG. 2 illustrates how the web 24 arrives at the wind-up device 35: the web is manually moved by the operator in the direction 101 and is fastened at the wind-up device. The wind-up device rotates in a direction of rotation 102 and winds up the web 24. The rotation is effected by the drive 100. The wound-up web 24 or a wound-up and separated section of the web 24 remains on the wind-up device 35 and is dispensed with. The web 24 is thus not moved back counter a direction 101.

Figure 4:
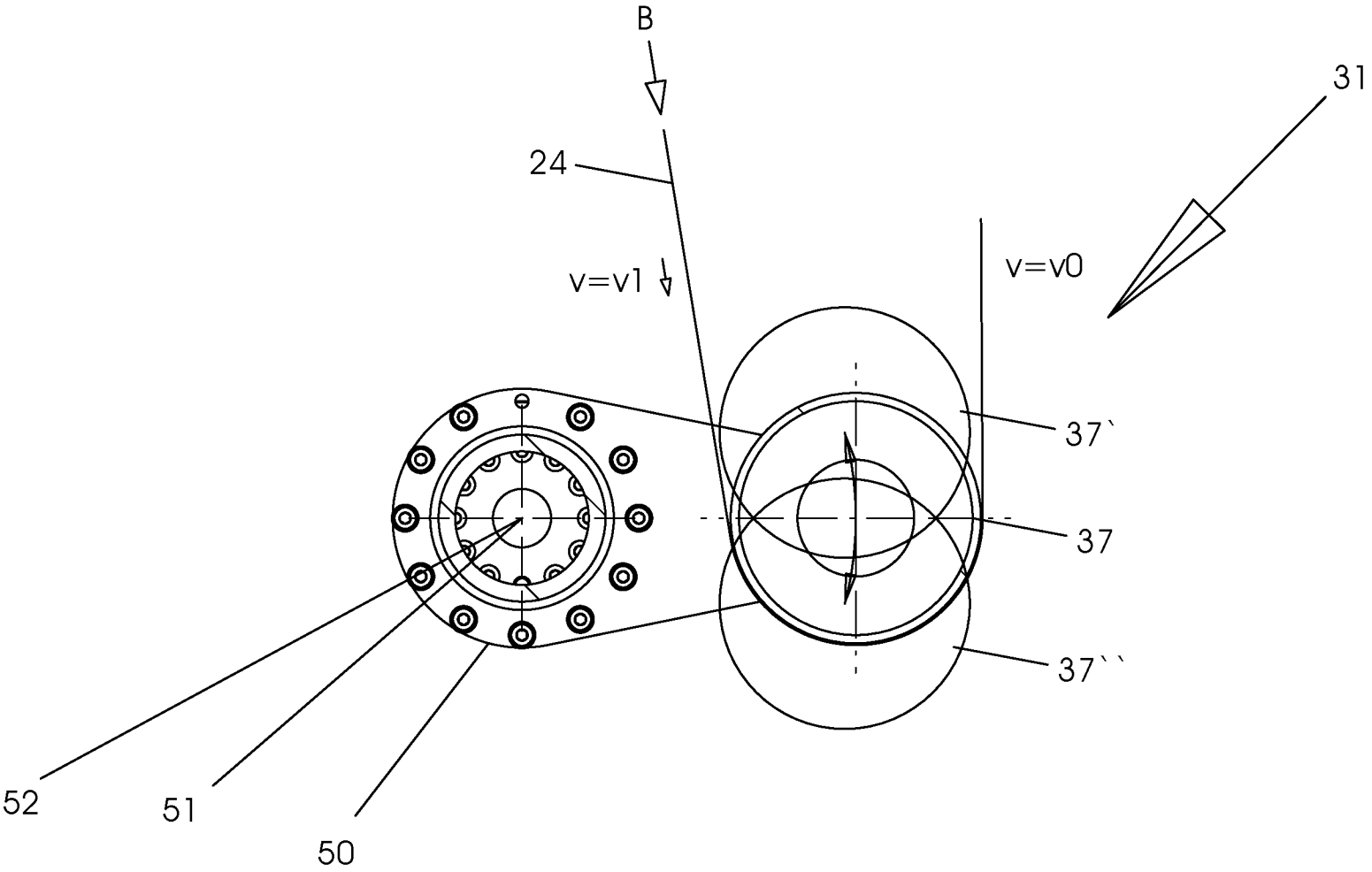
FIG. 4 is a view showing a detail of the manufacturing system of FIG. 1, namely the compensator.

The web 24 of printing material comes from a web-fed printing press 8, passes over various rollers 37, a pulling group 40, and a compensator 31 functioning as a web buffer to enter the flat-bed die-cutting machine 10. The web buffer which is shown in FIG. 4 has a conventional and well known construction. The compensator 31 includes a motor 52 rotating a shaft 51. Two parallel arms 50 are attached to the shaft 51. The arms rotate together with the shaft 51. Mounted between the two arms 50 is a support roller 37 supporting the web 24. The support roller 37 can rotate freely and can take different positions 37, 37', 37" to compensate for web tension. The roller will start from the position 37' and continue via the position 37 to the position 37". By doing so, the web 24 upstream has a velocity v=v1 and downstream it has a velocity v=v0 or zero, i.e. the web 24 is standing still in the downstream part. An iterative movement of the downstream part of the web can thereby be generated. When a new processing job is set up or when the upstream web-fed printing press 8 is stopped and is creating waste, the web 24 of printing material is not guided directly into the flat-bed die-cutting machine 10 but is initially wound onto an auxiliary wind-up device 35 in a direction w.

As soon as all sections of the web 24 of printing material that contain waste have been wound onto the auxiliary wind-up device 35, the web 24 of printing material may be introduced into the flat-bed die-cutting machine 10. This is achieved with the aid of the inserting device 30 of the invention. The situation in this particular moment is shown in more detail in FIG. 5, wherein the web 24 is lead through the inserting device 30, cutting edges 33.1 of a cutting unit 33, clamping rollers 32.1 of a clamping unit 32 and a gripping unit 34.1 of an inserting unit 34 are still spaced apart, letting the web 24 pass freely. The web 24 of printing material may be clamped and thus held in a defined way in the clamping unit 32. Then the cutting unit 33 may carry out a cross cut through the web 4 of printing material as a severing cut. While the auxiliary wind-up device 35 may continue to wind-up a flawed end of the web 24 of printing material, the flawless web 24 of printing material coming from the web-fed printing press 8 is guided, cross cut edge first, into the flat-bed die-cutting machine 10 by using the inserting unit 34 and the gripper unit 34.1 thereof. The gripper unit 34.1 is moved in a direction m on a guide path 34.2 in a direction B of web travel by a drive 34.3 and transfers the web 24 of printing material, cross cut edge first, to inserting rollers 36 of the flat-bed die-cutting machine 10. Once the transfer has been completed, the gripper unit 34.1 returns on the guide path 34.2 to its original position in the immediate vicinity of the clamping unit 32 and of the cutting unit 33, where the web 24 of printing material is transferred from the clamping unit 32 to the gripper unit 34.1 of the inserting unit 34.

Figure 3:
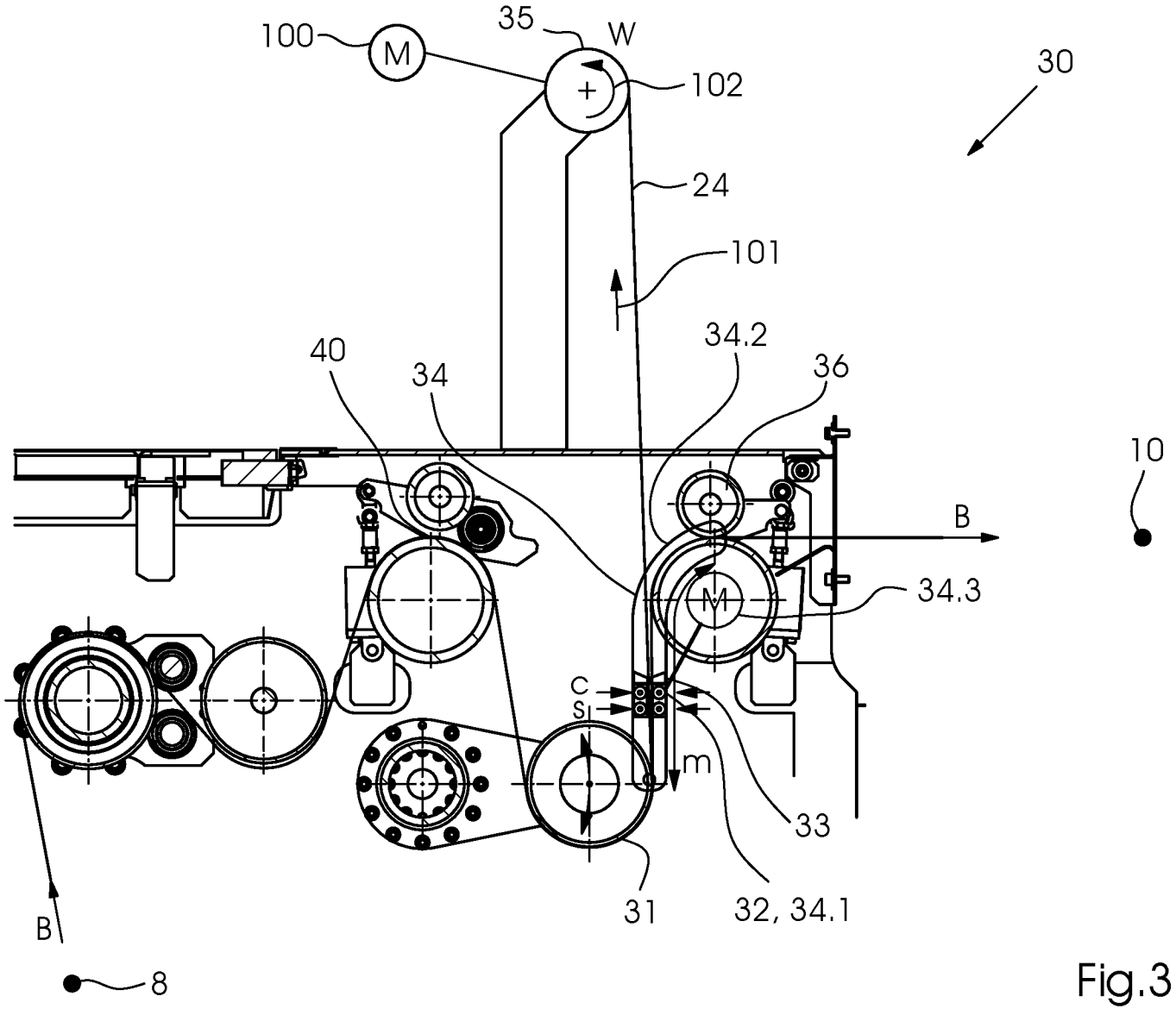
FIG. 3 is a view similar to FIG. 2 showing an alternative embodiment of the inserting device.

FIG. 3 illustrates an alternative embodiment of the inserting device 30. In the embodiment shown in FIG. 2, the clamping unit 32 and the cutting unit 33 on one hand and the gripper unit 34.1 of the inserting unit 34 on the other hand, are embodied as separate units and subassemblies. In the embodiment shown in FIG. 3, however, the clamping unit 32 and the gripper unit 34.1 are embodied as a single subassembly. Once a severing cut in the direction s has been made by the cutting unit 33, the web 24 of printing material remains clamped in a direction c by the clamping unit 32, which is simultaneously the gripper unit 34.1, and is moved in the direction m by this subassembly, driven by the drive 34.3, on the guide path 34.2 in the direction B of web travel to be fed to the flat-bed die-cutting machine 10. The motor (drive) 34.3 moves the group 30 (including, among others, the clamping unit 32 and the cutting unit 33) in the direction m and back again.

Figure 5:
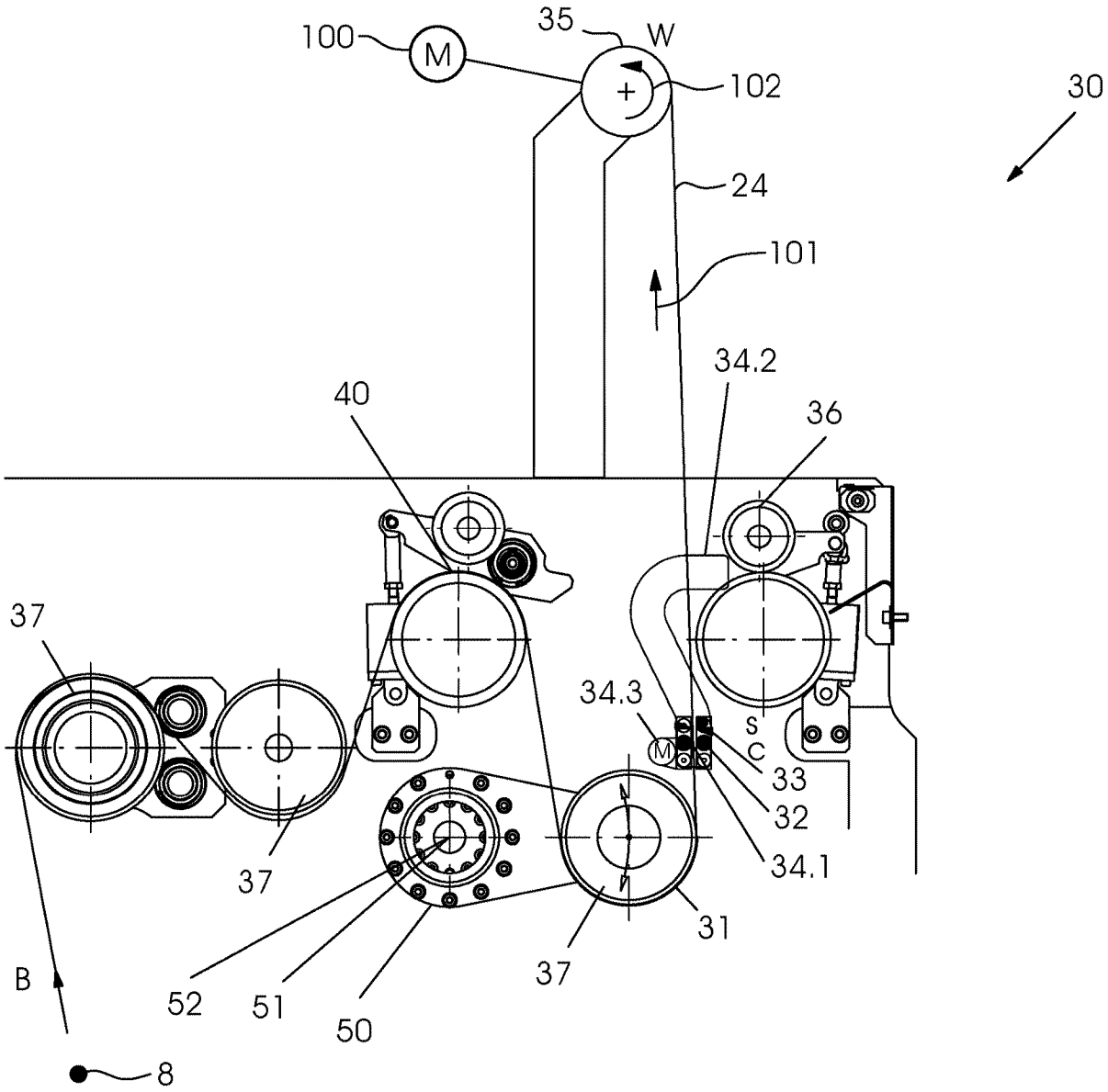
FIG. 5 is a view showing a detail of the manufacturing system of FIG. 1, namely the inserting device, at a moment before the inserting device is actuated.

Thus, in FIG. 3, the drive 34.3 is used for moving the unit or the group 30 from the clamping unit 32, the gripper unit 34.1 and the cutting unit 33 in the direction of movement m (backwards and forwards). The coupling required therefor is indicated by the diagonal, black line between the motor M and the group 30. In FIG. 5, the drive serves the same purpose—the drive is merely disposed at a different position, namely directly at the group 30 and a coupling is therefore not illustrated.

Figure 5A:
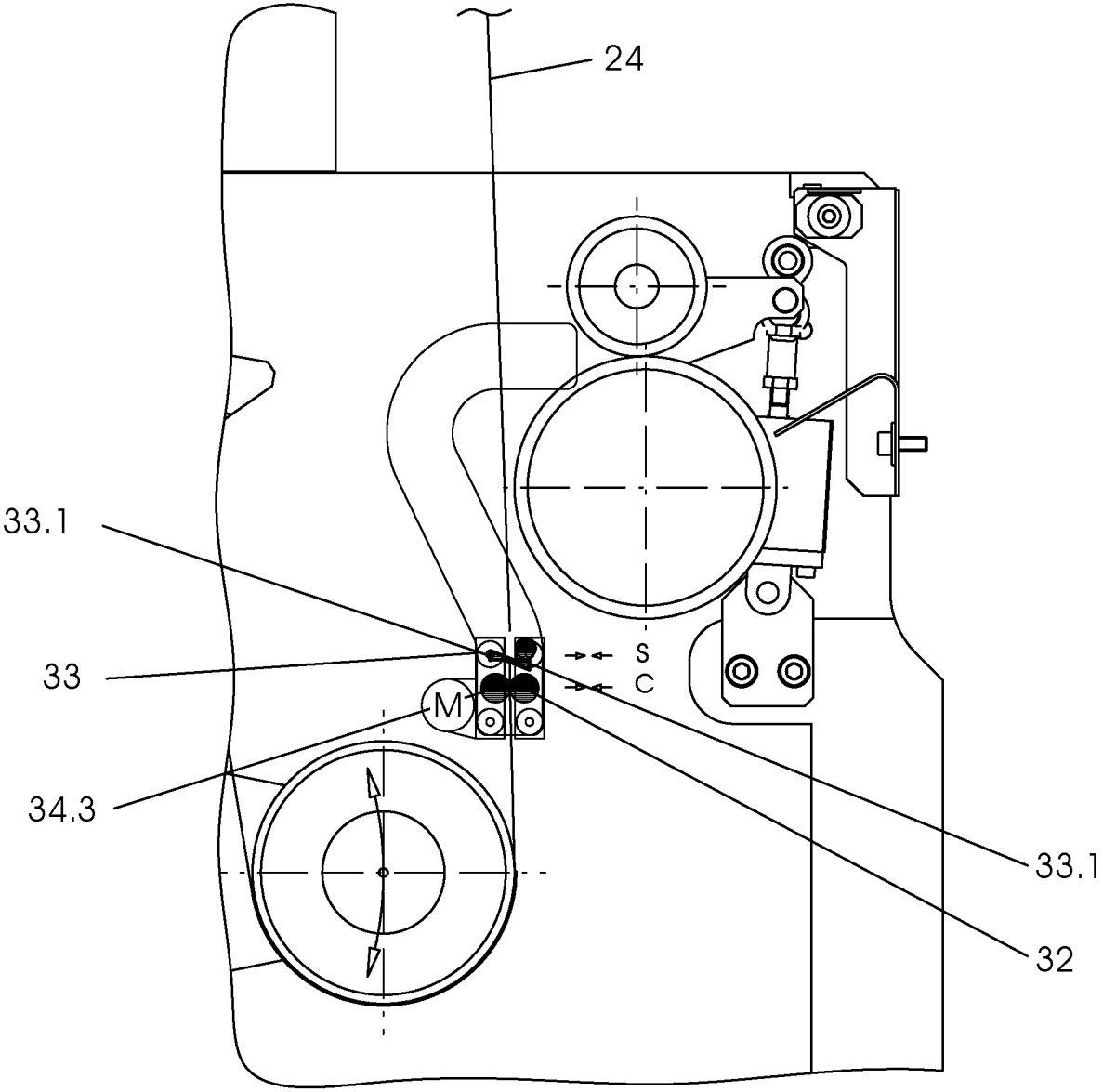
FIG. 5*a* is a view showing the inserting device at a particular moment when the clamping rollers are clamping the web and the cutting edges are cutting the web.
Figure 5B:
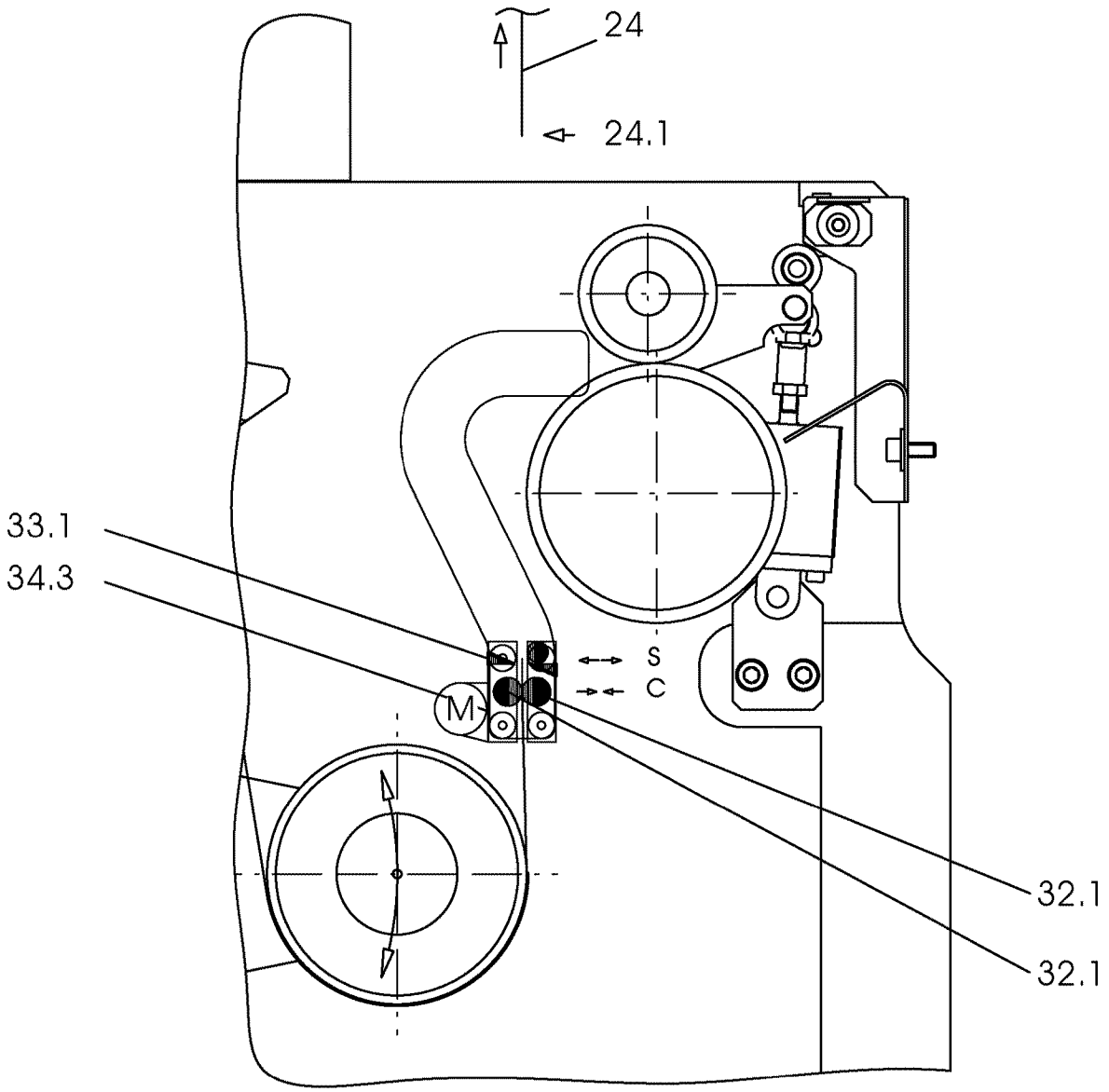
FIG. 5*b* is a view showing the inserting device at a particular moment when the clamping rollers are functioning as grippers and still clamping the web and the cutting is finished.
Figure 5C:
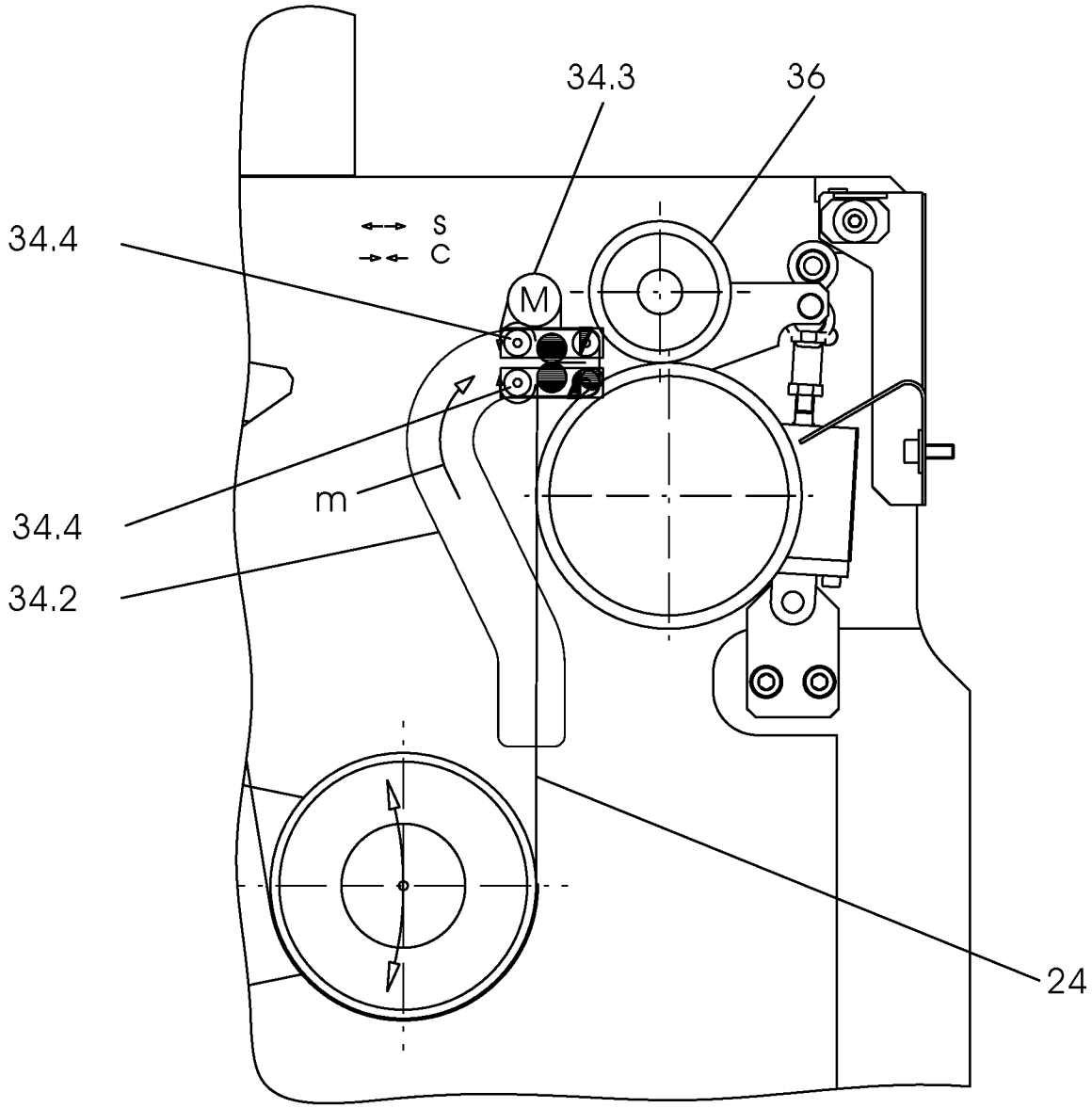
FIG. 5*c* is a view showing the inserting device at a particular moment after the gripper is moved towards the gap of inserting rollers of the flat-bed die-cutting machine.
Figure 5D:
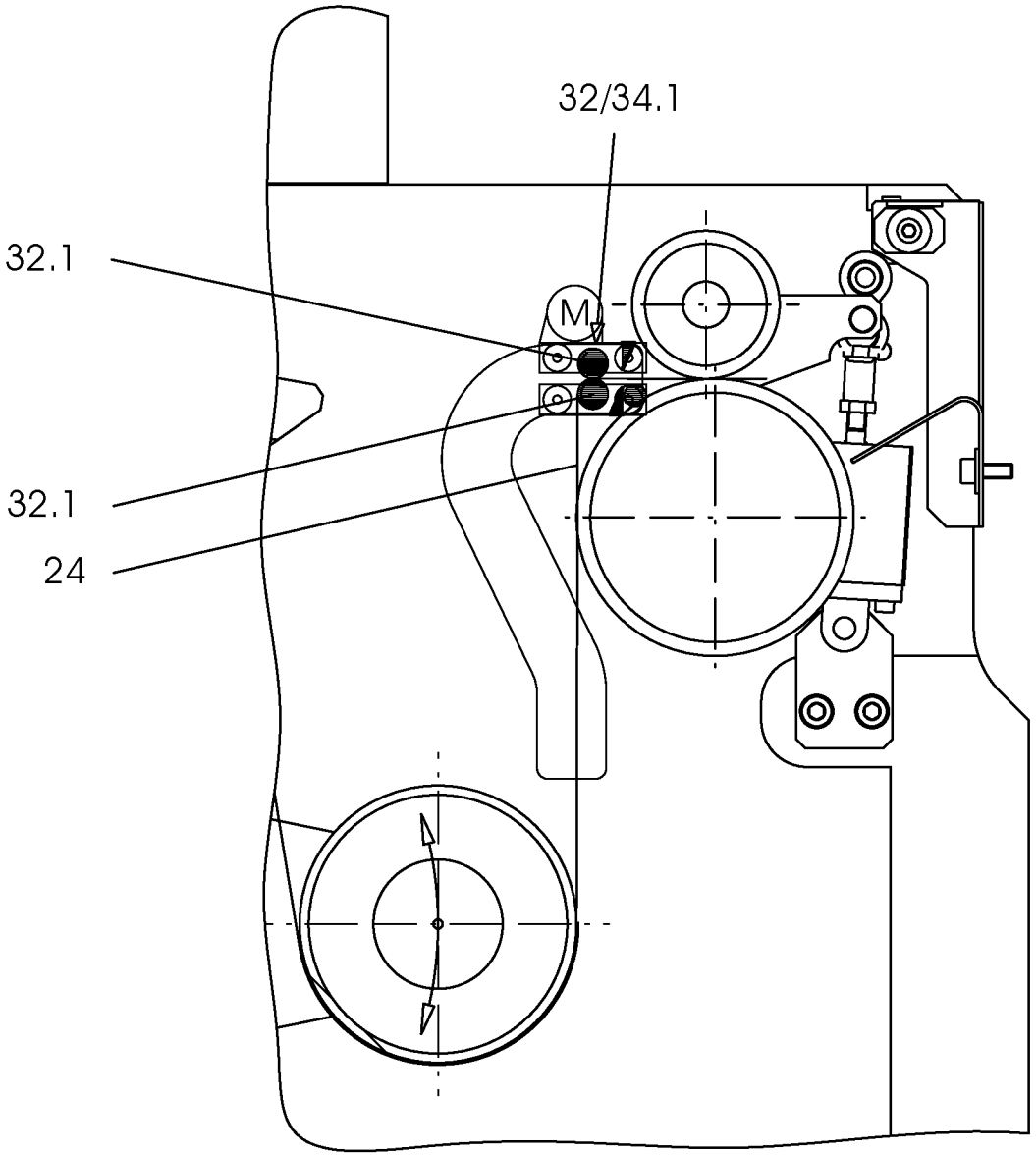
FIG. 5*d* is a view showing the inserting device at a particular moment when the cut web is moved towards the gap of inserting rollers of the flat-bed die-cutting machine.
Figure 5E:
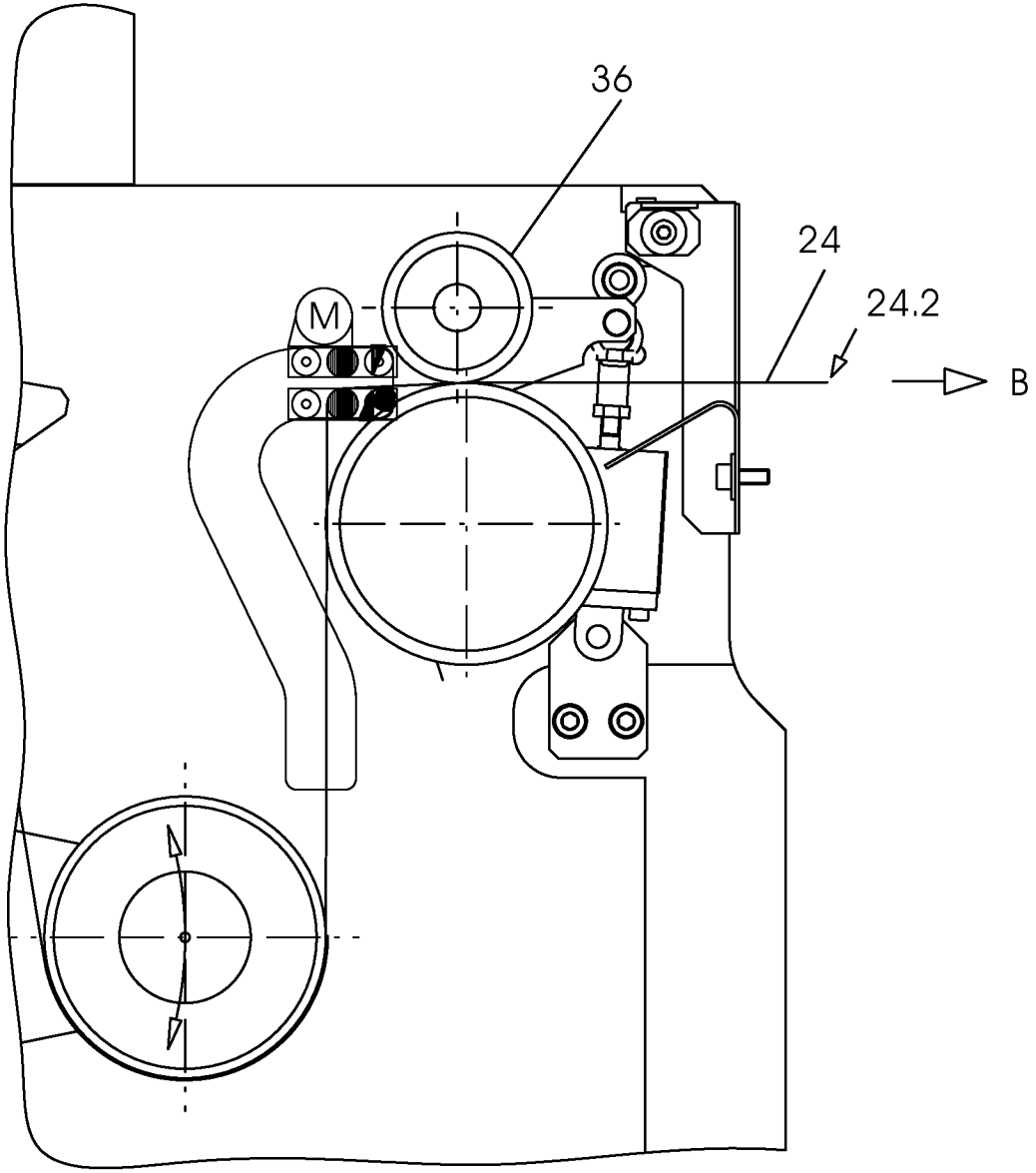
FIG. 5*e* is a view showing the inserting device at a particular moment when the transportation of the cut web is taken over by the inserting rollers of the flat-bed die-cutting machine.
Figure 5F:
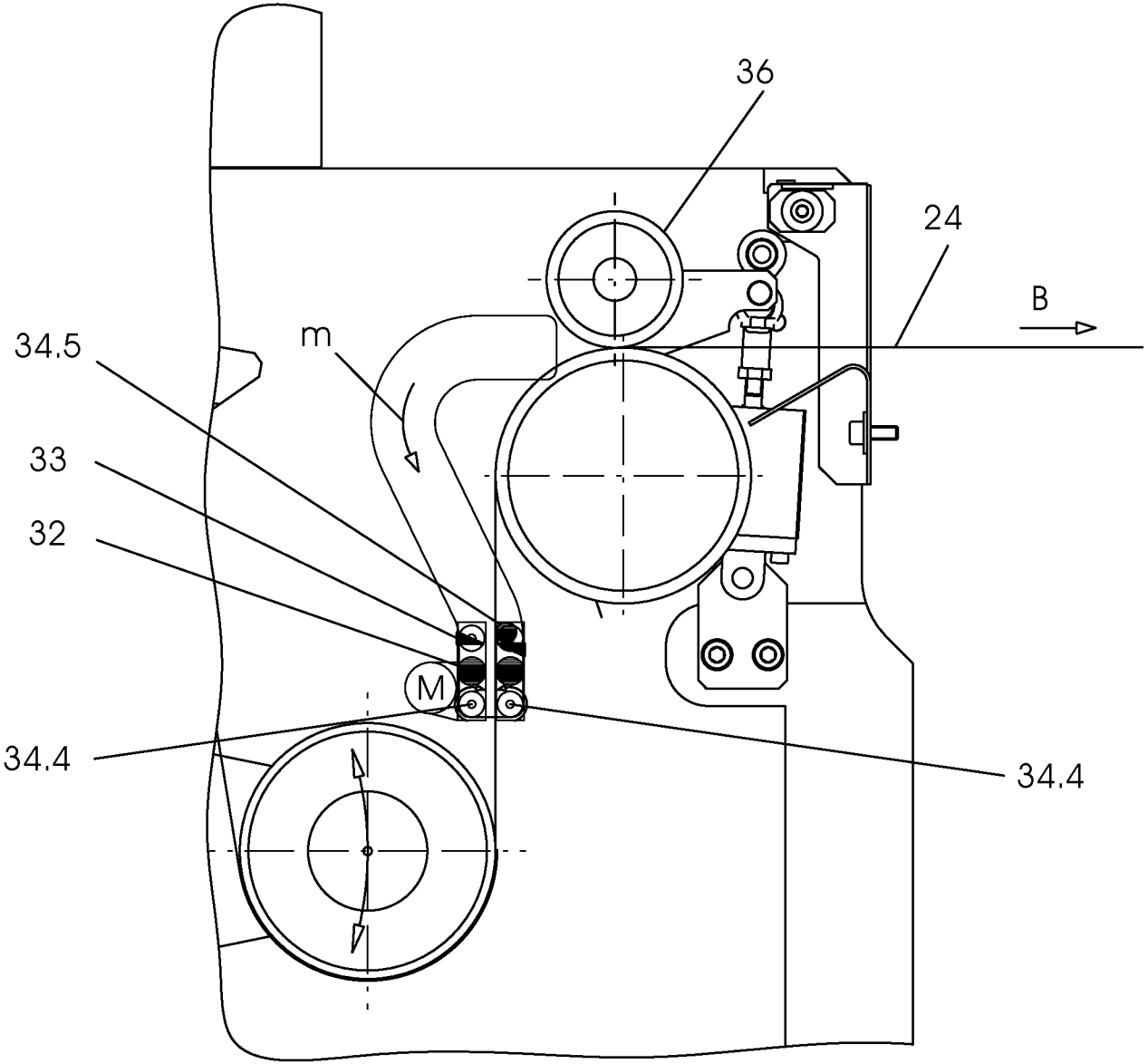
FIG. 5*f* is a view showing the inserting device at a particular moment when the subassembly of the clamping, cutting and gripping unit is moved back to its initial position.
Figure 6:
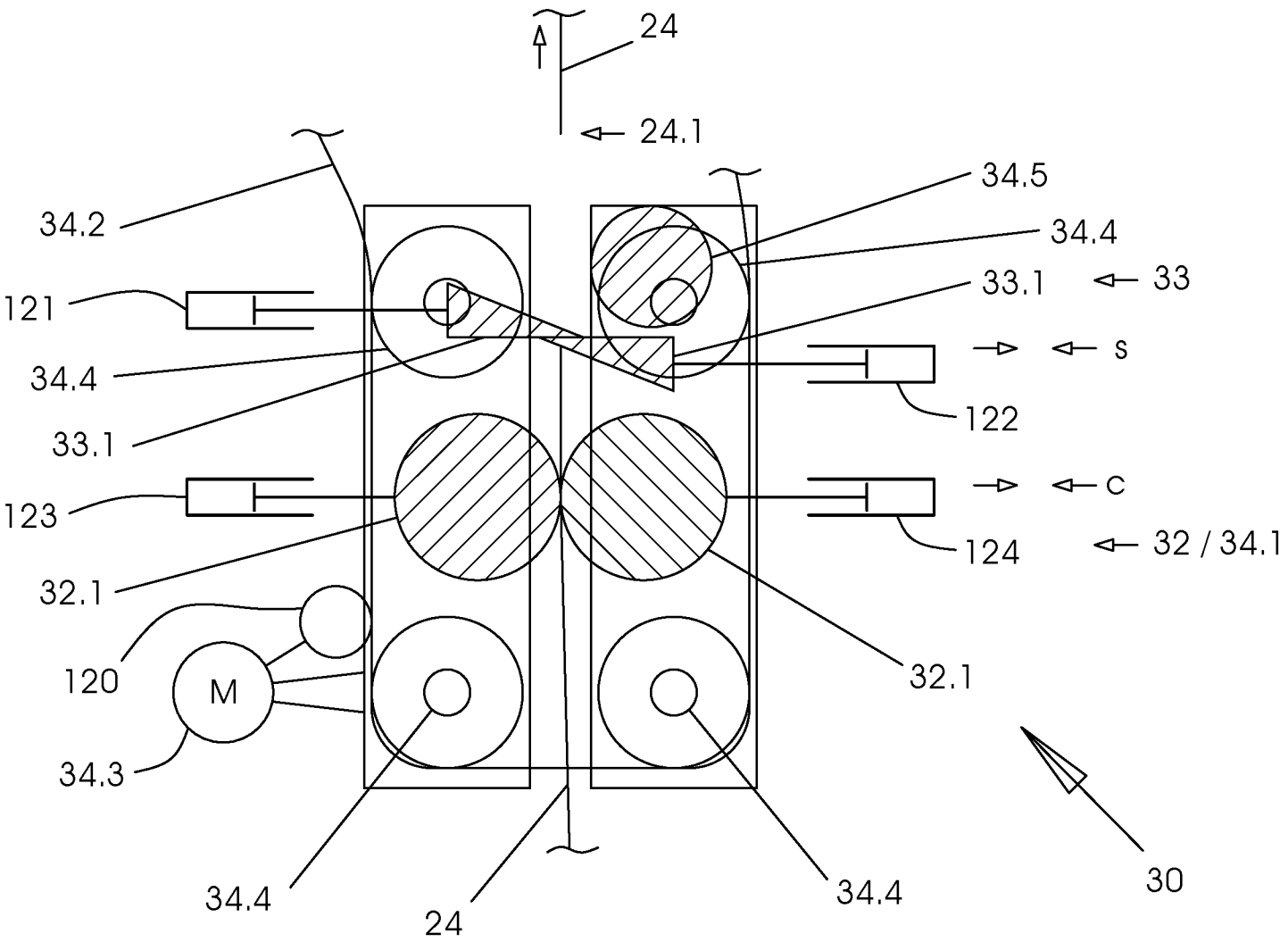
FIG. 6 is an even more detailed view of the inserting device with its elements, in which the view is taken at a moment directly after the web is cut.

The steps carried out during the operation of the inserting device 30 are explained below by making reference to FIGS. 5*a-d*, which should be read along with FIG. 6 showing the details of the inserting device 30 including the clamping unit 32, the cutting unit 33 and the inserting unit 34 on an enlarged scale. The motor (drive) 34.3 serves for driving the group 30 (including, among others, the clamping unit 32 and the cutting unit 33) in the direction m and back again (see FIGS. 5*a*-5*f*). The drive 34.3 does not serve for activating the clamping unit 32 and the cutting unit 33. FIG. 6 shows how the clamping unit 32 and the cutting unit 33 are activated. Pneumatic drives 121-124 are provided for this purpose. The steps are performed as follows:

FIG. 5*a*) The web 24 is clamped in a direction c and cut in a direction s by closing the two clamping rollers 32.1 of the clamping unit 32 and moving the two cutting edges 33.1 of the cutting unit 33 towards each other, with the clamping rollers 32.1 and cutting edges 33.1 being actuated by the drive or motor 34.3. The wind-up device 35 continues to wind up the web 24 that has already passed the inserting device 30 until its trailing edge 24.1.

FIG. 5*b*) The web is now cut into two pieces, forming an upstream part and a downstream part. The cutting edges 33.1 of the cutting unit 33 are opened. The downstream part of the web is wound-up completely by the wind-up device 35. The upstream part of the web has to be fed to the flat-bed die-cutting machine 10.

FIG. 5*c*) The clamping unit 32 changes its function to act as the gripper unit 34.1 and the drive or motor 34.3 moves the gripper unit 34.1 in the direction m along a transport or guide path 34.2. The movement m is carried out by transmitting the rotation of the motor to guide wheels 34.4 which roll along the guide path 34.2. A leading edge 24.2 of the web 24 remains gripped.

FIG. 5*d*) The gripping force of the gripper unit 34.1 is reduced and the motor 34.3 rotates the clamping rollers 32.1 to move the web 24 with its leading edge 24.2 towards a gap between the rollers 36.

Afterwards, the subassembly 32, 33, 34.1 is moved back into its initial position and transportation of the web 24 is carried out by the rollers 36 (see FIG. 5*e*). In FIG. 5*f* the subassembly is back in its initial position, with the web passing freely between the clamping rollers 32.1 and along a guiding roller 34.5.

FIG. 6 shows the motor (drive) 34.3 which drives a friction wheel 120, as well as the pneumatic drives 121, 122 for the cutting edges 33.1 and the pneumatic drives 123, 124 for the clamping rollers 32.1. The drive 34.3 serves the same purpose in FIG. 6 as in FIGS. 3 and 5. In this embodiment, the force for moving the group 30 is transferred by the friction wheel 120.

The invention claimed is:

1. A device for inserting a web of printing material, including paper or board, into a flat-bed machine for at least one of die-cutting or embossing, the device comprising:

a compensator comprising a rover, wherein the compensator configured to convert a continuous movement of the web of printing material into an iterative movement by changing a speed of the web of printing material through changes of position of the roller;

a clamping unit configured to clamp the web of printing material;

a cutting unit configured to carry out a cross cut through the web of printing material, creating a cross out edge;

said clamping unit and said cutting unit being mutually adjacent; and an inserting unit configured to transport the web of printing material, cross cut edge first, into the flat-bed machine for at least one of die-cutting or embossing.

2. The inserting device according to claim 1, wherein said inserting unit includes a gripper unit configured to grip the web of printing material, at least one guide path and a drive associated with said gripper unit, said gripper unit configured to be displaced along said at least one guide path and moved by said drive.

3. The inserting device according to claim 2, wherein said clamping unit and said gripper unit are constructed as one subassembly.

4. The inserting device according to claim 1, which further comprises an auxiliary wind-up device for winding up the web of printing material, said auxiliary wind-up device being disposed downstream of said compensator.

5. The inserting device according to claim 1, wherein said clamping unit, said cutting unit and said inserting unit are disposed between said compensator and the flat-bed machine for at least one of die-cutting or embossing.

6. The inserting device according to claim 1, wherein said cutting unit includes a knife and a counter-element cooperating with said knife, said knife and said counter-element extending across a width of the web of printing material.

7. A manufacturing system for the production of packages, including paper or board packages and folding boxes, from a web of printing material, the manufacturing system comprising:

a web-fed printing press;

an inserting device disposed downstream of said web-fed printing press; and a flat-bed machine for at least one of die-cutting or embossing disposed downstream of said inserting device;

said inserting device including a compensator comprising a roller, wherein the compensator configured to convert a continuous movement of the web of printing material into an iterative movement by changing a speed of the web of printing material through changes of position of the roller, a clamping unit configured to clamp the web of printing material while being cut, a cutting unit configured to carry out a cross cut through the web of printing material, creating a cross cut edge, said clamping unit and said cutting unit being mutually adjacent, and an inserting unit configured to transport the web of printing material, cross cut edge first, into the flat-bed machine for at least one of die-cutting or embossing.

* * * * *